US006928254B2

(12) United States Patent
Choi et al.

(10) Patent No.: US 6,928,254 B2
(45) Date of Patent: Aug. 9, 2005

(54) APPARATUS AND METHOD OF FORMING MULTI-COLOR IMAGES

(75) Inventors: Min-ho Choi, Gyeonggi-do (KR); Kyung-hwan Kim, Gyeonggi-do (KR); Myung-ho Kyung, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 5 days.

(21) Appl. No.: 10/620,768

(22) Filed: Jul. 17, 2003

(65) Prior Publication Data

US 2004/0057753 A1 Mar. 25, 2004

(30) Foreign Application Priority Data

Jul. 24, 2002 (KR) ..... 10-2002-0043586

(51) Int. Cl.[7] ..... G03G 15/01
(52) U.S. Cl. ..... 399/230; 399/55; 399/223
(58) Field of Search ..... 399/223, 228, 399/230, 55, 88

(56) References Cited

U.S. PATENT DOCUMENTS 4,887,102 A * 12/1989 Yoshikawa et al.
5,030,996 A * 7/1991 Tajima et al.
5,307,127 A * 4/1994 Kobayashi et al. ..... 399/223
5,404,205 A * 4/1995 Saito
5,557,392 A * 9/1996 Iwata ..... 399/223
5,678,130 A * 10/1997 Enomoto et al.
6,188,860 B1 * 2/2001 Huang
6,272,304 B1 * 8/2001 Saito et al.

FOREIGN PATENT DOCUMENTS

JP 06-242657 9/1994
JP 10282758 A * 10/1998 ..... G03G/15/01

* cited by examiner

*Primary Examiner*—Susan Lee
(74) *Attorney, Agent, or Firm*—Staas & Halsey LLP

(57) ABSTRACT

A color image forming apparatus includes a photoreceptor medium, an exposing unit, a plurality of developer units, and a power supply. The exposing unit scans light onto the photoreceptor drum to form a latent electrostatic image. The plurality of developer units include developer rollers supplying toner to the latent electrostatic image to develop the latent electrostatic image into a toner image. Each developer unit contains toner of a different color, and the developer units are arranged around the photoreceptor medium so that the developer rollers are separated by a development gap from the photoreceptor medium. The power supply selectively applies a first bias allowing toner to be supplied through the development gap to the photoreceptor medium on which the latent electrostatic image is formed and a second bias preventing toner from passing through the development gap.

19 Claims, 8 Drawing Sheets

APPARATUS AND METHOD OF FORMING MULTI-COLOR IMAGES

CROSS-REFERENCE TO RELATED APPLICATIONS

This application claims the priority of Korean Patent Application No. 2002-43586, filed on Jul. 24, 2002, in the Korean Intellectual Property Office, the disclosure of which is incorporated herein in its entirety by reference.

BACKGROUND OF THE INVENTION

1. Field of the Invention

The present invention relates to an apparatus and a method of forming multi-color images, and more particularly, to an electrophotographic color image forming apparatus and method using a multi-pass method by which a multi-color image is formed by repeatedly exposing, developing, and transferring toner of different colors using a laser scanning unit (LSU) and a photoreceptor medium.

2. Description of the Related Art

In general, an electrophotographic color image forming apparatus forms a latent electrostatic image by scanning light onto a photoreceptor medium charged with a predetermined potential, develops the latent electrostatic image into a predetermined color toner image using a developer unit, and transfers and fixes the predetermined color toner image to a paper to form a color image. Colors of toner used in a color image forming apparatus are generally yellow (Y), magenta (M), cyan (C), and black (K). Thus, four developer units to develop toner of four colors are required.

The method of forming a color image includes a single-pass method performed using four LSUs and four photoreceptor media and a multi-pass method performed using an LSU and a photoreceptor medium.

FIG. 1 is a schematic view of a color image forming apparatus using a single pass method. Referring to FIG. 1, the color image forming apparatus includes photoreceptor drums 120C, 120M, 120Y, and 120K, LSUs 110C, 110M, 110Y, and 110K, and developer units 130C, 130M, 130Y, and 130B corresponding to toner colors. The photoreceptor drums 120C, 120M, 120Y, and 120K are adjacent to a transfer belt 140. The transfer belt 140 is circulated by driving rollers 150 driven at a predetermined speed. One of the driving rollers 150 faces a transfer roller 160, with the transfer belt 140 passing between them. Sheets of paper S are fed in the gap between the transfer roller 160 and the transfer belt 140.

A process of forming a color image using the color image forming apparatus having the above-described structure will be described.

Light corresponding to a cyan image is scanned onto the photoreceptor drum 120C by the LSU 110C to form a latent electrostatic image. Cyan toner C included in the developer unit 130C sticks to the latent electrostatic image, and thus a cyan toner image is formed on the photoreceptor drum 120C and transferred to the transfer belt 140. After a predetermined period of time elapses from the time when the cyan image is exposed, the LSU 110M scans light corresponding to a magenta image onto the photoreceptor drum 120M to form a latent electrostatic image. Magenta toner M included in the developer unit 130M sticks to the latent electrostatic image, and thus a magenta toner image is formed on the photoreceptor drum 120M and transferred to the transfer belt 140. Here, the exposing timings of the LSU 110C and 110M are controlled to accurately overlap the cyan toner image and the magenta toner image transferred to the transfer belt 140. Yellow and black toner images are also transferred to the transfer belt 140 using the above-described method, and thus a multi-color toner image is formed on the transfer belt 140. The multi-color toner image is transferred to a sheet of paper S fed between the transfer belt 140 and the transfer roller 160. A fixing unit 170 heats and presses the sheet of paper S to fix and fuse the multi-color toner image to the sheet of paper S. As a result, a multi-color image is completed.

In the above-described color image forming apparatus using the single pass method, a complete color image is formed by only a single rotation of the transfer belt 140. A black-and-white image can also be formed by only a single rotation of the transfer belt 140. In other words, the time required for printing a color image is the same as the time required for printing a black-and-white image. Thus, the color image forming apparatus is mainly used in high-speed printing.

However, if timing for the foregoing exposures is not accurately controlled in consideration of the relative positions of LSUs and photoreceptor drums, multi-color toner images are not accurately overlapped and high-quality color images cannot be formed. Also, since four LSUs and four photoreceptor drums are required, the costs of forming color images increase.

A color image forming apparatus operating in a low-speed mode due to these problems includes a photoreceptor drum and an LSU and uses a multi-pass method in which an exposure process, a development process, and a transfer process are repeated for each of the colors to form a multi-color image. The multi-pass method is classified into a rotary method and a slider method according to the arrangement and switching method of developer units respectively corresponding to colors.

FIG. 2 is a schematic view of a color image forming apparatus using a rotary method. Referring to FIG. 2, the color image forming apparatus includes a photoreceptor drum 220, an LSU 210 which scans light onto the photoreceptor drum 220, a transfer belt 240 which is adjacent to the photoreceptor drum 220, and a turret 280 which rotates. Developer units 230C, 230M, 230Y, and 230K are disposed on the turret 280 such that whenever the turret 280 rotates by an angle of 90° in a counterclockwise direction, the developer units 230C, 230M, 230Y, and 230K sequentially approach the photoreceptor drum 220. The length of the transfer belt 240 is equal to or longer than the maximum length of a sheet of paper S used in the color image forming apparatus.

The operation of the color image forming apparatus having the above-described structure is presented below.

When the developer unit 230C approaches the photoreceptor drum 220 following the rotation of the turret 280, the LSU 210 scans light corresponding to a cyan image onto the photoreceptor drum 220 to form a latent electrostatic image. Cyan toner C included in the developer unit 230C sticks to the latent electrostatic image, and thus a cyan toner image is formed on the photoreceptor 220 and transferred to the transfer belt 240.

After the cyan toner image is completely transferred to the transfer belt 240, the turret 280 rotates again by an angle of 90°, the developer unit 230M approaches the photoreceptor 220, and the LSU 210 scans light corresponding to a magenta image onto the photoreceptor drum 220 to form a latent electrostatic image. Magenta toner M included in the developer unit 230M sticks to the latent electrostatic image, and a magenta toner image is formed on the photoreceptor drum 220 and transferred to the transfer belt 240.

In FIG. 2, timing of the scanning of light corresponding to the magenta image from the LSU 210 is controlled in consideration of the circulation speed of the transfer belt 240 so that the end of the cyan toner image formed on the transfer belt 240 accurately overlaps with the end of the magenta toner image transferred from the photoreceptor drum 220 to the transfer belt 240.

The above-described process is repeated for yellow (Y) and black (K) images. Then, cyan, magenta, yellow, and black toner images are overlapped on the transfer belt 240, and transferred and fixed to a sheet of paper S so that a multi-color image is formed.

FIG. 3 is a schematic view of a color image forming apparatus using a slider method. Referring to FIG. 3, the color image forming apparatus includes developer units 330C, 330M, 330Y, and 330K which are arranged in the direction of movement of a photoreceptor belt 320 and a cam 380 which selectively slides the developer units 330C, 330M, 330Y, and 330K forward and backward in a horizontal direction.

The developer units 330C, 330M, 330Y, and 330K are arranged so that developer rollers 331 are disposed at an initial distance Di from the photoreceptor belt 320. In the color image forming apparatus of FIG. 3, the initial distance Di is greater than a development gap Dg, as shown is FIG. 5, which allows toner on the developer rollers 331 to be transferred to transfer belt 320. Thus, when the developer units 330C, 330M, 330Y, and 330K are maintained at the initial distance Di from the photoreceptor belt 320, toner is not transferred from the developer units 330C, 330M, 330Y, and 330K to the photoreceptor belt 320.

However, when an image is formed, the cam 380 rotates to slide a selected one 330M of the developer units 330C, 330M, 330Y, and 330K toward the photoreceptor belt 320 so that a distance between the selected developer unit 330M and the photoreceptor belt 320 becomes equal to the development gap Dg. Thus, development is possible with only the selected developer unit 330M.

According to the above-described structure, the cam 380 selectively rotates so as to selectively slide sequentially the developer units 330C, 330M, 330Y, and 330K toward the photoreceptor belt 320 so that development is carried out. As a result, cyan, magenta, yellow and black toner images are formed on a transfer belt 340, and transferred and fixed to a sheet of paper S so as to form a multi-color image.

However, in a color image forming apparatus using a multi-pass method as described in FIGS. 2 and 3, unselected developer units are separated from a photoreceptor belt or a photoreceptor drum at a distance greater than the development gap Dg to prevent toner sticking to the unselected developer unit, from being transferred to the photoreceptor drum or the photoreceptor belt and contaminating a multi-color image. The turret 280 should rotate or the cam 380 should operate to slide developer units so that only a selected developer unit is separated by the development gap Dg from the photoreceptor drum or the photoreceptor belt. Thus, an additional driving motor (not shown) is required to operate the turret 280 or the cam 380. Alternatively, if a driving motor (not shown) driving the photoreceptor drum is also used to drive the turret 280 or the cam 380, a complicated switching mechanism is required.

In addition, noise is unavoidable when the turret 280 rotates or the cam 380 operates and the lifespan of a driving system (not shown) may be shortened due to the functional impact with the turret 280 or the cam 380. Also, the impact made by the developing unit reduces the quality of the color images formed.

SUMMARY OF THE INVENTION

An aspect of the present invention is to provide a color image forming apparatus using a multi-pass method, in which a plurality of developer units do not rotate or slide, and in which developer rollers of the plurality of developer units are arranged at a development gap from a photoreceptor medium.

Additional aspects and advantages of the invention will be set forth in part in the description which follows and, in part, will be obvious from the description, or may be learned by practice of the invention.

The foregoing and/or other aspects of the present invention are achieved by providing a color image forming apparatus including a photoreceptor medium, an exposing unit, a plurality of developer units, and a power supply. The exposing unit scans light onto the photoreceptor drum to form a latent electrostatic image. The plurality of developer units includes developer rollers supplying toner to the latent electrostatic image to develop the latent electrostatic image into a toner image. Each developer unit includes toner of a different color than other of the developer units, and the developer units are arranged around the photoreceptor medium so that the developer rollers are separated by a development gap from the photoreceptor medium. The power supply selectively applies a first bias allowing toner to be supplied through the development gap to the photoreceptor medium on which the latent electrostatic image is formed and a second bias preventing toner from passing through the development gap.

The foregoing and/or other aspects of the present invention may also be achieved by providing a method of forming a multi-color image. The method includes: arranging a plurality of developer units including toner of different colors and developer rollers so that the developer rollers are separated by a development gap from the photoreceptor medium; scanning light corresponding to an image of a selected color onto the surface of a photoreceptor medium that is charged to form a latent electrostatic image; applying a first bias to a developer roller of one of a plurality of developer units including toner of a selected color so that toner of the selected color is fed to the latent electrostatic image via the development gap; applying a second bias to developer rollers of developer units of the unselected developer units to prevent toner from moving through the development gap; and transferring the toner image formed on the photoreceptor medium to a transfer medium. In the present invention, the method operations are repeated for toner of different colors to form a multi-color toner image on the transfer medium, transfer the multi-color toner image to a sheet of paper, fix and fuse the multi-color toner image to the sheet of paper, and form a multi-color image.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
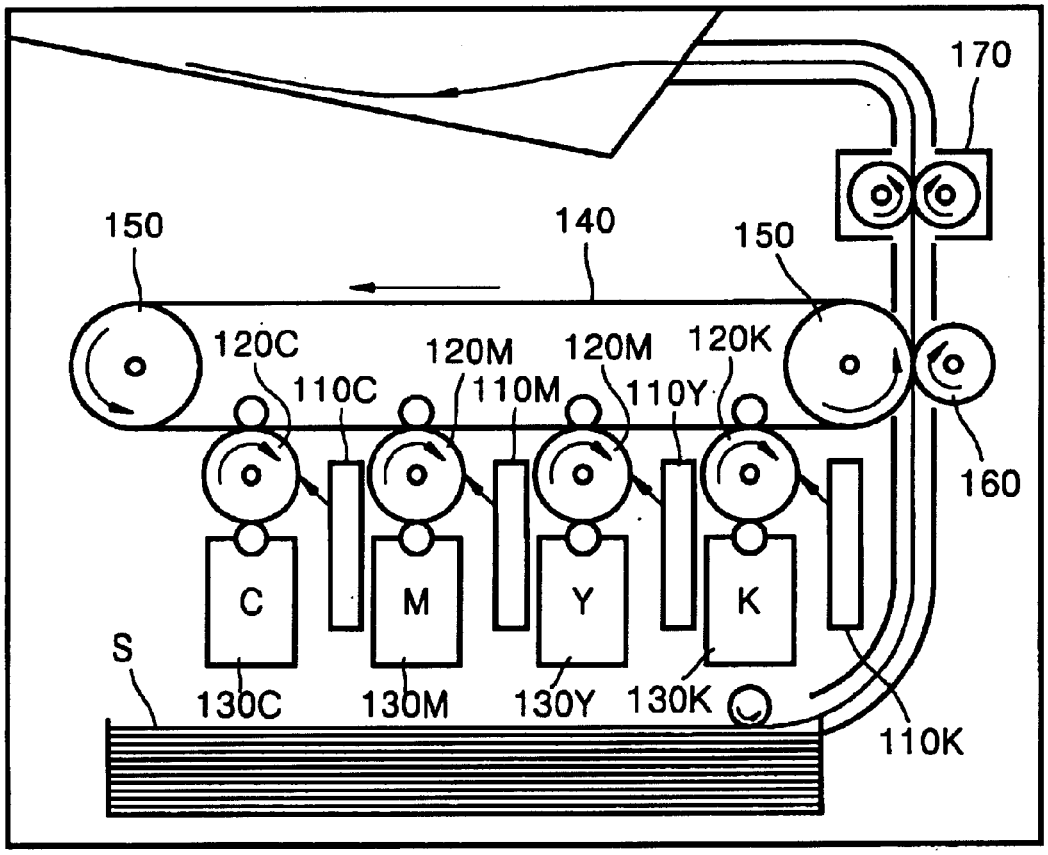
FIG. 1 (PRIOR ART)
FIG. 1 is a schematic view of a conventional color image forming apparatus using a single pass method.

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

Figure 4:
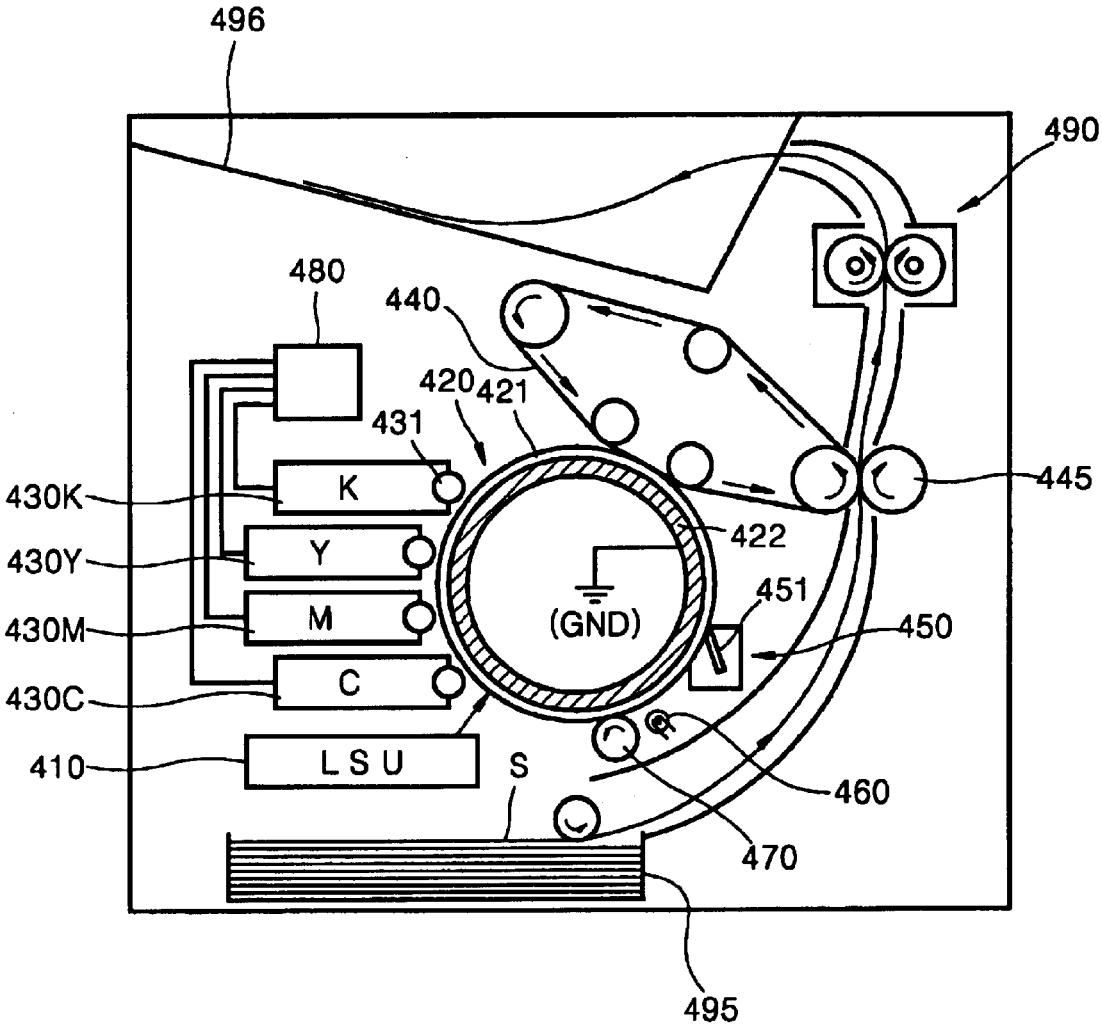
FIG. 4 is a schematic view of a color image forming apparatus according to an embodiment of the present invention.

FIG. 4 shows a color image forming apparatus according to an embodiment of the present invention. Referring to FIG. 4, the color image forming apparatus includes a charging roller 470, a laser scanning unit 410 as an exposing unit, developer units 430C, 430M, 430Y, and 430K, a transfer belt 440, a cleaning unit 450, and a discharging roller 460. The color image forming apparatus further includes a power supply 480 which supplies power to the developer units 430C, 430M, 430Y, and 430K, a cassette 495 which feeds sheets of paper S, a transfer roller 445 which transfers a sheet of paper S so that the sheet of paper S contacts the transfer belt 440, and a fixing unit 490 which fixes and fuses a toner image transferred to the sheet of paper S.

In this embodiment, the photoreceptor drum 420, which is made by coating the exterior surface of a metal drum 422 with a photoconductive material 421, is used as a photoreceptor medium. The photoreceptor medium is not limited to this apparatus and may use any similar unit that can receive a toner image thereon, such as, for example, a photoreceptor belt (not shown) which circulates around a continuous path. The metal drum 422 has a potential of electrical ground GND. The linear velocity of the circumference of the photoreceptor drum 420 that is rotating is equal to the circulation velocity of the transfer belt 440.

In this embodiment, the charging roller 470 is used to charge the photoreceptor drum 420 with an equal potential. However, a charging unit using a corona charger (not shown) may be employed instead of the charging roller 470. The charging roller 470 rotates in contact with the exterior surface of the photoreceptor drum 420 to charge the photoreceptor drum 420 with an equal potential. The charge supplied to the exterior surface of the photoreceptor drum 420 by the charging roller 420 may be a (+) charge or a (−) charge. In this embodiment, a (−) charge is supplied to the photoreceptor drum 420.

The LSU 410 scans light onto the photoreceptor drum 420 that is rotating to form a latent electrostatic image thereon. In the present invention, since only one LSU 410 is used, cyan, magenta, yellow, and black images are sequentially exposed on the photoreceptor drum 420.

The developer units 430C, 430M, 430Y, and 430K, respectively including cyan C, magenta M, yellow Y, and black M color toners, are adjacent to the exterior surface of the photoreceptor drum 420. It is an aspect that the developer units 430C, 430M, 430Y, and 430K are includes as a cartridge that can be attached to and detached from the color image forming apparatus.

Figure 5:
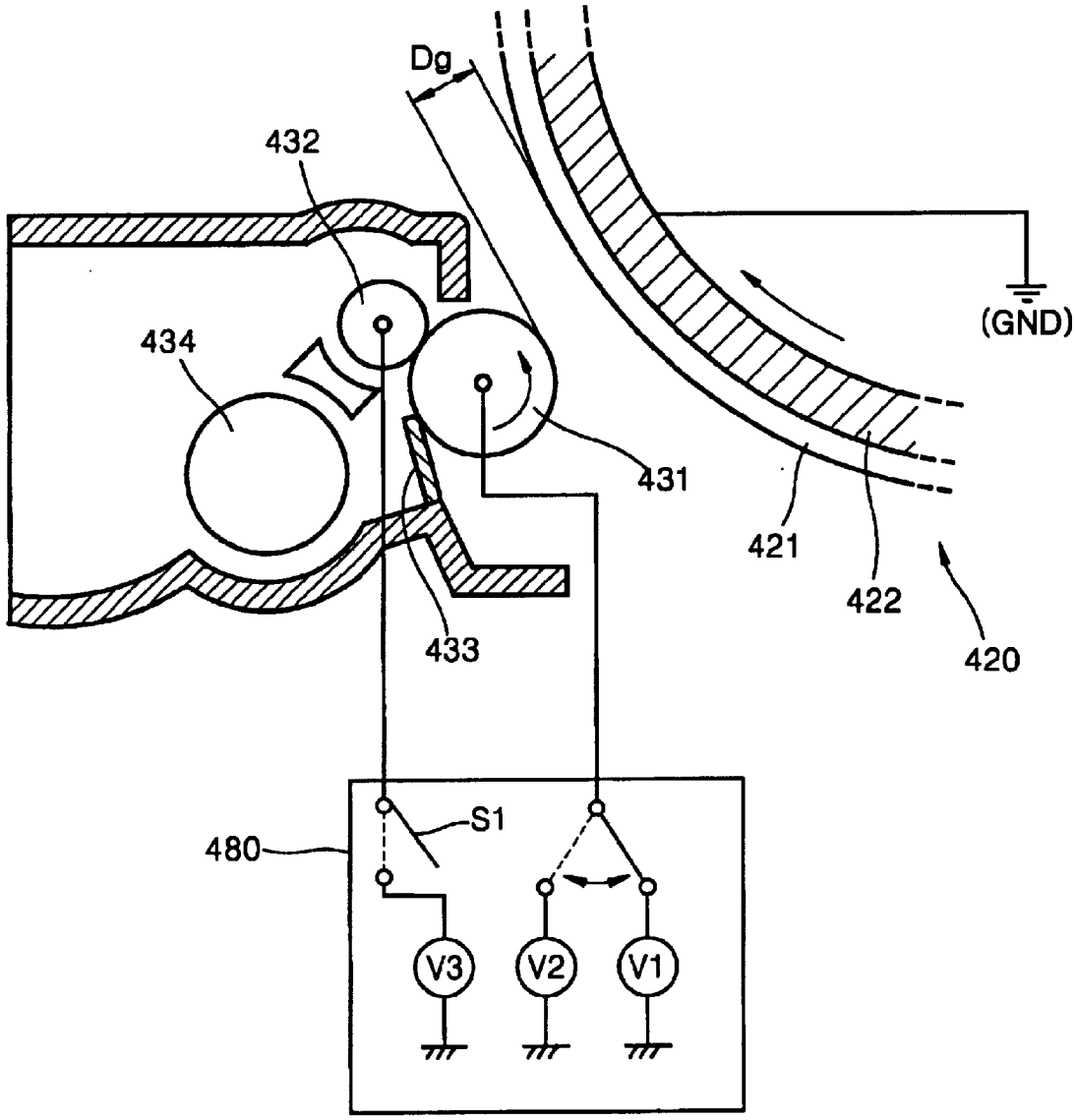
FIG. 5 is a schematic view of developer units and a power supply shown in FIG. 4.

FIG. 5 shows one of the developer units 430C, 430M, 430Y, and 430K (indicated as 430 in FIG. 5) and the power supply 480 shown in FIG. 4. As shown in FIG. 5, each of the developer units 430C, 430M, 430Y, and 430K includes a developer roller 431 which feeds toner to a latent electrostatic image formed on the photoreceptor drum 420, a first roller 432 which sticks toner to the developer roller 431, a regulating unit 433 which regulates the amount of toner sticking to the developer roller 431, and a second roller 434 which feeds toner to the first roller 432 and the developer roller 431.

It is an aspect of the invention that the developer rollers 431 are formed of a semi-conductive rubber, but the developer rollers 431 may be also formed of a metal material.

The developer units 430C, 430M, 430Y, and 430K are arranged so that the developer roller 431 is separated from the exterior surface of the photoreceptor 420 by the development gap Dg. In this embodiment, toner is of a nonmagnetic-one-component-type and is charged with a (−) charge in the developer units 430C, 430M, 430Y, and 430K.

Figure 2:
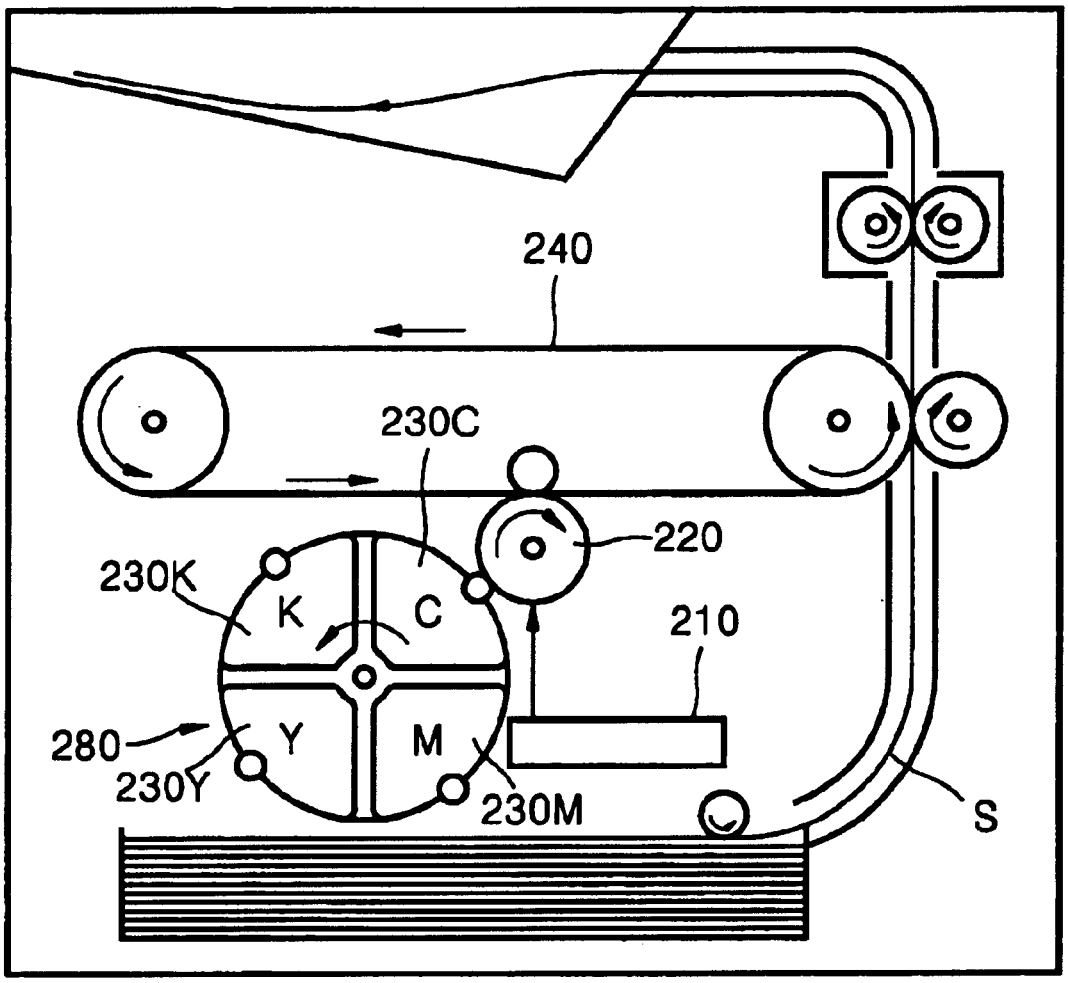
FIG. 2 (PRIOR ART)
FIG. 2 is a schematic view of a conventional color image forming apparatus using a rotary method.
Figure 3:
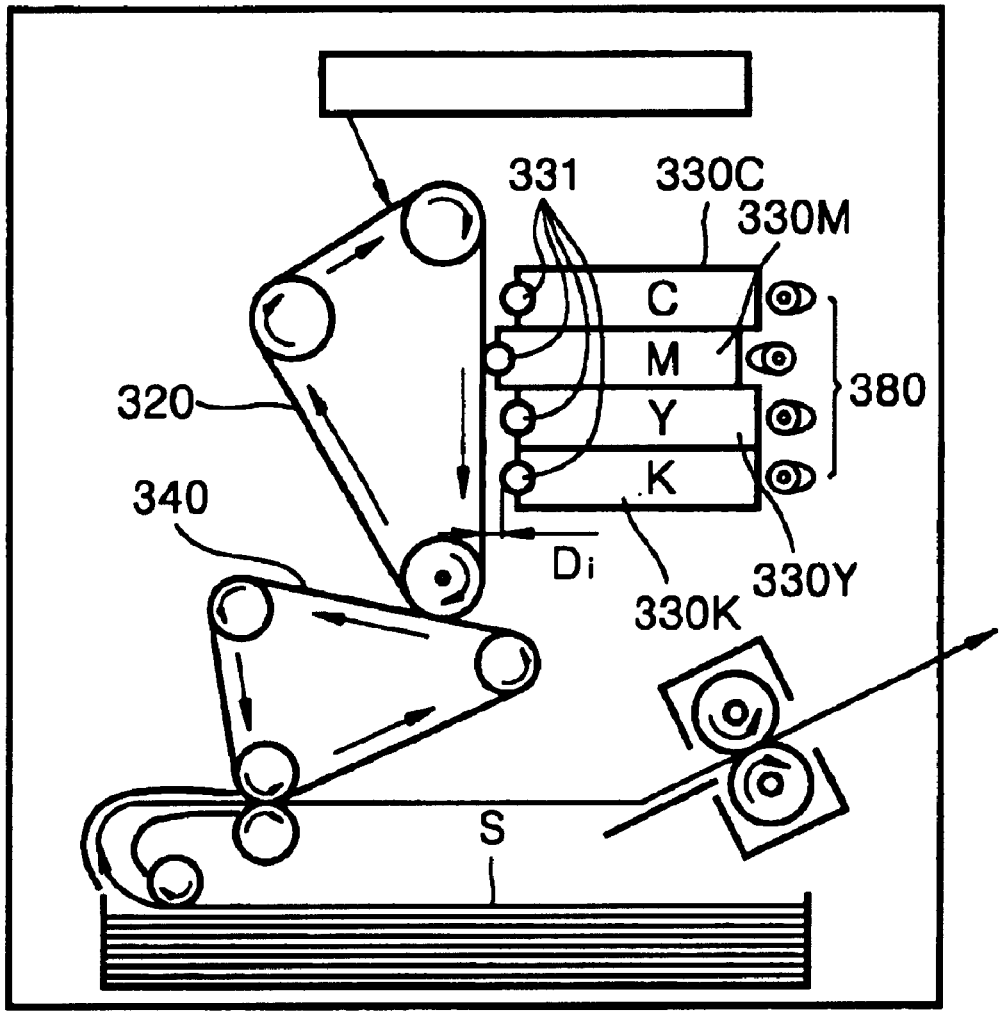
FIG. 3 (PRIOR ART)
FIG. 3 is a schematic view of a conventional color image forming apparatus using a slider method.

The power supply 480 selectively applies a first bias V1 and a second bias V2 to the developer rollers 431 and a third bias V3 to the first rollers 432. Unlike the color image forming apparatuses shown in FIGS. 2 and 3, in the color image forming apparatus of the present invention, a plurality of developer units are separated from a photoreceptor drum by the development gap Dg. In the color image forming apparatus of the present invention, the power supply 480 can selectively apply the first bias V1 and the second bias V2 to the developer rollers 431 so that a developer unit is selected from a plurality of developer units. Therefore, the turret 280 shown in FIG. 2 or the cam 380 shown in FIG. 3, which selects a developer unit to perform a development operation from a plurality of developer units, is not required.

The first bias V1 forms a potential difference between developer rollers and latent electrostatic images so that toner passes through the development gap Dg, sticks to a latent electrostatic image formed on the exterior surface of the photoreceptor drum 420, and is developed. The first bias V1 is applied to a developer roller 431 of one selected from a plurality of developer units. In this embodiment, since toner is charged with a (−) polarity, a direct current (DC) bias and an alternating current (AC) bias are applied together as the first bias V1 bias. When the first bias V1 is applied, the toner charged with the (−) charge passes through the development gap Dg and sticks to the latent electrostatic image.

The value of the first bias V1 depends on the size of the development gap Dg, development characteristics, and leakage current characteristics. The development characteristics are expressed by the optical density of toner remaining on the developer rollers 431 after printing a solid image. The leakage current characteristics depend on the intensity of the first bias V1. As such, the leakage current flows from the developer rollers 431 to the photoreceptor drum 420 due to cracks in the insulation in the development gap Dg between the developer rollers 431 and the photoreceptor drum 420. In order to measure the development characteristics, after printing the solid image, toner remaining on the developer rollers 431 is separated from the developer rollers 431 by a transparent tape and then attached onto a clean sheet. Thereafter, the optical density of the toner is measured using a density measurer. The density measurer may be a SPECTROEYE manufactured by GRETAGMACBETH.

Figure 6:
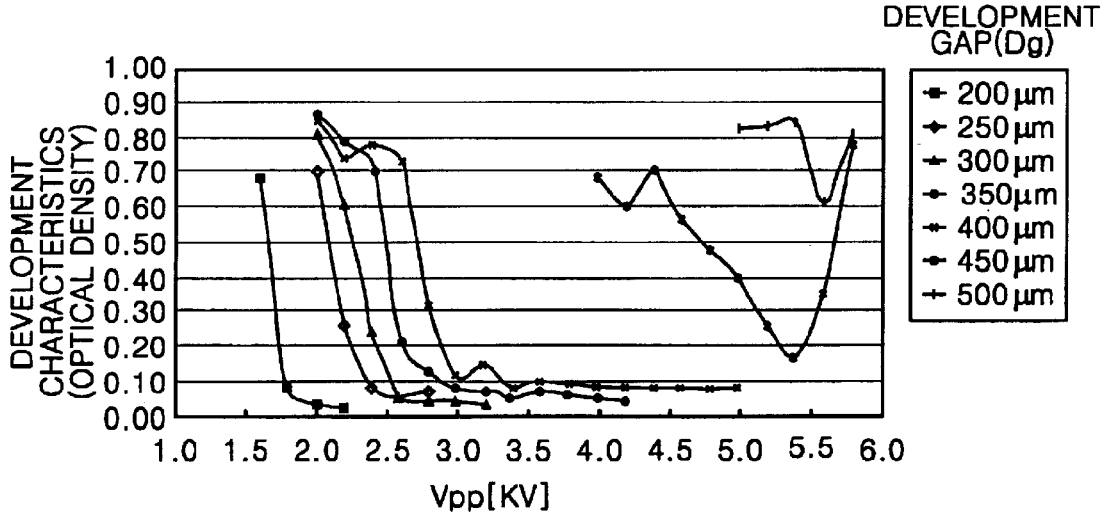
FIGS. 6 and 7 are graphs illustrating development characteristics measured using a color toner A and a color toner B.
Figure 7:
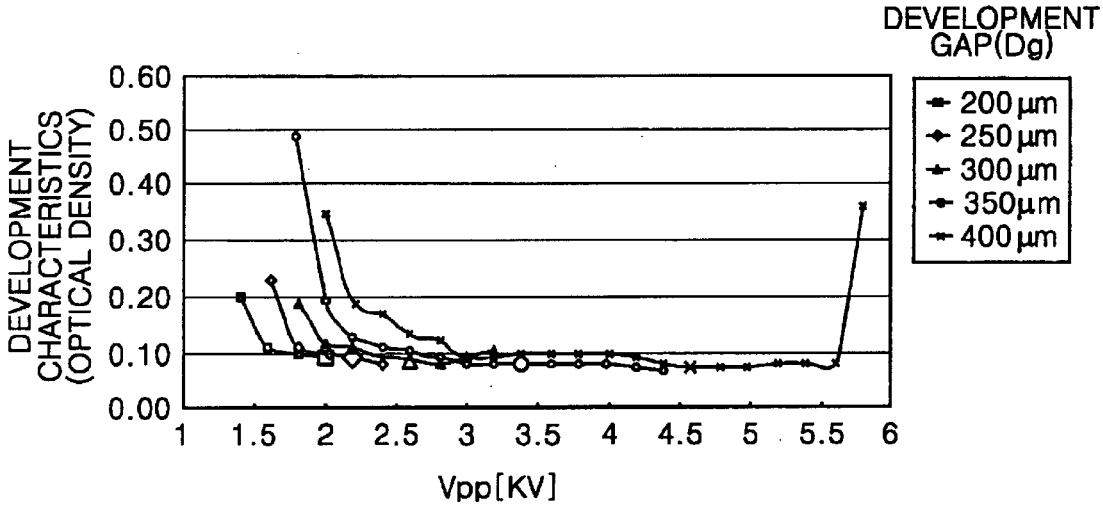
Figure 8:
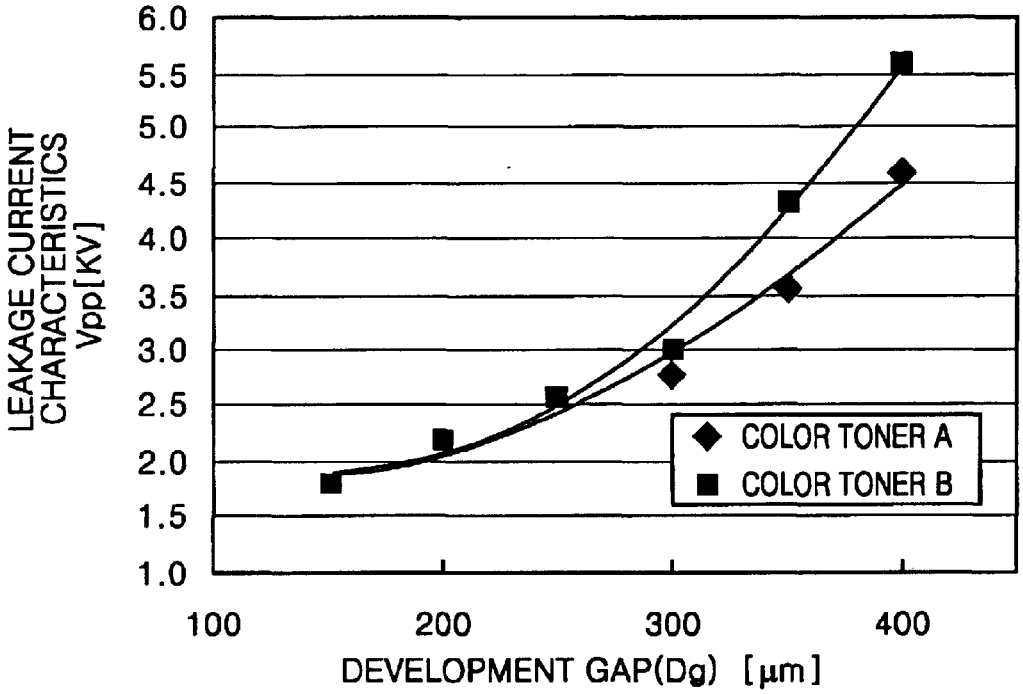
FIG. 8 is a graph illustrating leakage current characteristics measured using color toner A and color toner B.

FIGS. 6 and 7 are graphs illustrating development characteristics measured using color toner A and color toner B, respectively. FIG. 8 is a graph illustrating leakage current characteristics measured using color toner A and color toner B. In FIGS. 6–8, Vpp represents a peak-to-peak voltage of the first bias V1. The color toner A is manufactured by the Japanese corporation TOMOEGAWA, and the color toner B is manufactured by the Japanese corporation TOSHIBA.

As the optical density of toner remaining on the developer rollers 431 is low, the development characteristics are good. The development gap Dg and the first bias V1 are determined so that the optical density depending on the development characteristics becomes 0.1 or less within the limit that a leakage current does not flow. Here, as the development gap Dg increases, the intensity of the first bias V increases. If the development gap Dg becomes excessively large, toner exceeds the range of the development gap Dg and is scattered in the color image forming apparatus. Thus, it is preferable that the development gap Dg is set within a range of 50–400 $\mu$m.

If the first bias V1 is determined in consideration of the size of the development gap Dg, the development characteristics, and the leakage current characteristics from the results of the experiment, for example, the potential of the photoreceptor drum 420 may be set to 750V, the first bias V1 applied to the developer rollers 431 may be a square wave with a direct current of 450V, and a frequency may be set to 2 KHz. Also, a third bias V3 applied to the first rollers 432 may be equal to the first bias V1.

In contrast to the first bias V1, the second bias V2 blocks the movement of toner through the development gap Dg. The second bias V2 is applied to the developer rollers 431 of unselected developer units in order to prevent toner from reaching a first contamination level where toner contained in the unselected developer units sticks to the photoreceptor drum 420 and a second contamination level where toner sticking to a latent electrostatic image on the photoreceptor drum 420 passes through the development gap Dg and sticks to the developer rollers 431 of the unselected developer units. Here, the intensity of the second bias V2 is determined experimentally according to the development gap Dg or theoretically.

Figure 9:
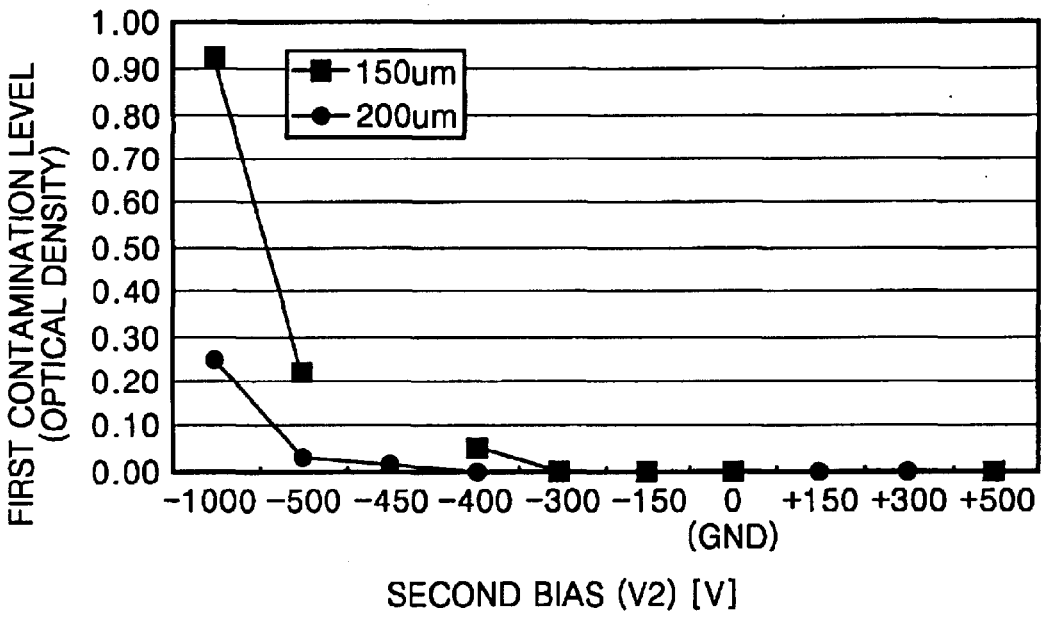
FIG. 9 is a graph illustrating a first contamination level of a toner image on a photoreceptor drum versus a second bias V2 for different development gaps Dg.

FIG. 9 is a graph illustrating a first contamination level of toner versus the second bias V2 for different development gaps Dg. A white image is printed in order to measure the first contamination level. Since a latent electrostatic image is not formed on the surface of the photoreceptor drum 420 when the white image is printed, toner must not theoretically stick to the photoreceptor drum 420. However, a small amount of toner may be attached onto the photoreceptor drum 420 depending on the value of the second bias V2. The toner on the photoreceptor drum 420 is separated from the photoreceptor drum 420 by a transparent tape, the transparent tape being attached onto a white sheet. An optical density of toner is measured by a density measurer. The density measurer may be the SPECTROEYE manufactured by GRETAGMACBETH.

In this embodiment, only data measured when the development gap Dg is 150 $\mu$m and 200 $\mu$m is shown. However, various values of the second bias V2 can be obtained depending on variations in the size of the development gap Dg.

Figure 10:
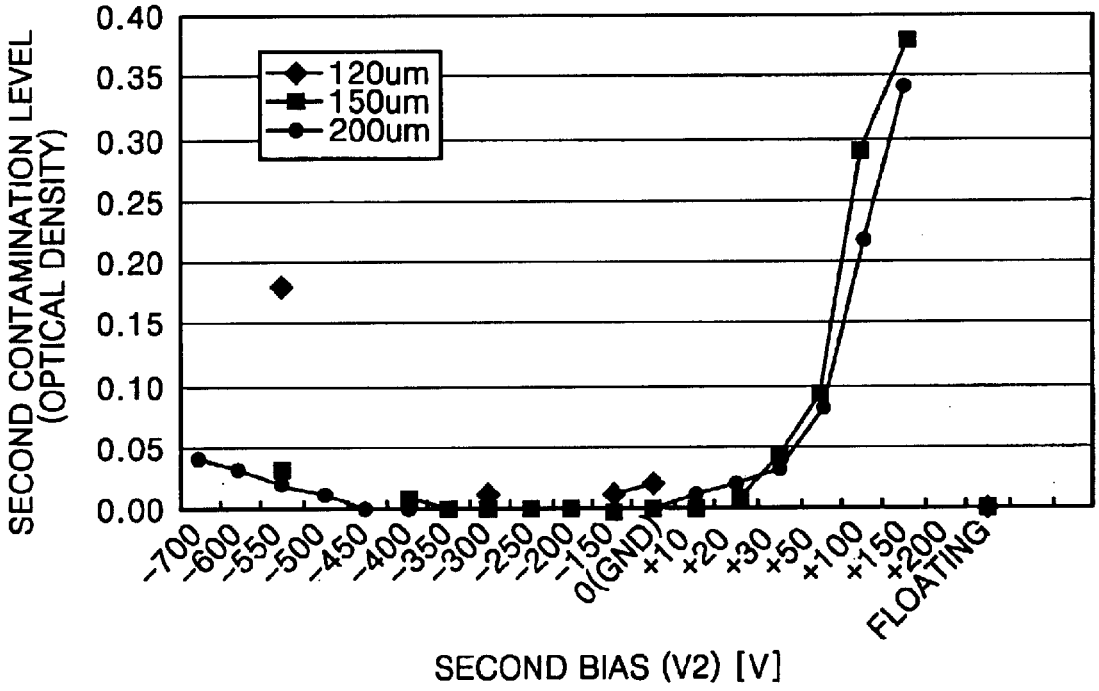
FIG. 10 is a graph illustrating a second contamination level of developer rollers versus the second bias V2 for development gaps Dg.

FIG. 10 is a graph illustrating a second contamination level of toner versus the second bias V2 for different development gaps Dg. In order to measure the second contamination level, one color solid image is printed. Next, the color toner of the solid image, which is attached onto the developer rollers 431 of the developer units containing color toners different from the used color toner, is separated from the developer rollers 431 using a transparent tape. Thereafter, the transparent tape is attached onto a white sheet and an optical density of the toner is measured using a density measurer. Here, a color filter is used to measure the optical density of toner of color tone used for printing. The density measurer may be the SPECTROEYE manufactured by GRETAGMACBETH.

From the results shown in FIGS. 9 and 10, the intensity of the second bias V2 to be applied to the development gap Dg is determined. In this embodiment, the contamination level of an image allowable in the color image forming apparatus is set to be at an optical density of about 0.03. Thus, from the results shown in FIGS. 9 and 10, the development gap Dg and the second bias V2 satisfying an optical density of less than 0.03 are selected. Referring to FIGS. 9 and 10, when the development Dg is 150 $\mu$m, the second bias V2 is selected within a range of −300V to +10V. When the development gap Dg is 200 $\mu$m, the second bias V2 is selected within a range of −400V to +10V. Although not shown in FIGS. 9 and 10, the second bias V2 may be generally selected within a range of −600V +50V, inclusive, between 50 $\mu$m and 400 $\mu$m that is a selectable range of the development gap Dg. The second bias V2 may electrically float. As seen in FIGS. 9 and 10, the effective range of the second bias V2 increases with an increase in the development gap Dg.

The theoretical method of determining the second bias V2 will be further described. The undesired toner contamination as described above occurs when the intensity of an electrical field between the photoreceptor drum 420 and the developer rollers 431 is greater than a cohesive force between toner powders in a toner layer formed on the photoreceptor drum 420 or the developer rollers 431. The intensity of the electrical field is called a critical electrical field Ec. If the absolute value of the intensity of the electrical field between the photoreceptor drum 420 and the developer rollers 431 is greater than the value of the critical electrical field Ec, toner contamination occurs from the developer rollers 431 to the photoreceptor drum 420 or in the opposite direction. Thus, the value of the second bias V2 may be determined so that the intensity of the electric field between the photoreceptor drum 420 and the developer rollers 431 is between −Ec and +Ec. According to the above-described theoretical structure, the intensity of the second bias V2 may be theoretically calculated using parameters such as the thickness of a photosensitive layer and the thickness of a toner layer formed on a photoreceptor drum, the size of the development gap Dg, the charge density of the toner layer, the photosensitive layer, air in the development gap Dg, a dielectric constant of the toner layer, the potential of an exposed portion of the photoreceptor drum, and the like.

The third bias V3 allows toner in developer units to stick to the developer rollers 431. The third bias V3 is applied to only one of the first rollers 432 of one of the developer rollers 431 to which the first bias V1 is applied so as to develop a latent electrostatic image and not to one of the first rollers 432 of one of the developer rollers 431 to which the second bias V2 is applied. For this reason, the power supply 480 may include a switch S1 as shown in FIG. 5. As described above, the third bias V3 may be equal to the first bias V1.

The transfer belt 440 transfers toner images of four colors overlapped thereon from the photoreceptor drum 420 to a sheet of paper S. In this embodiment, the transfer belt 420 is used as a transfer medium. However, the transfer belt 420 may be a transfer drum or other similar transfer units that provide the intended operation of transferring the toner images. The length of the transfer belt 440 has to be equal to or greater than the maximum length of a sheet of paper S used in the color image forming apparatus.

The cleaning unit 450 removes toner remaining on the exterior surface of the photoreceptor drum 420 after the transfer process. In this embodiment, the cleaning unit 450 includes a cleaning blade 451 contacting the exterior surface of the photoreceptor drum 420. However, the cleaning unit 450 may include a cleaning roller which rotates in contact with the exterior surface of the photoreceptor drum 420.

The discharging roller 460 is generally a discharging lamp which radiates light of a predetermined intensity onto the exterior surface of the photoreceptor drum 420 to equalize the surface potential of the photoreceptor drum 420.

A method of forming a multi-color image using the color image forming apparatus having the above-described structure will now be described.

A multi-color image is formed of a mixture of cyan C, magenta M, yellow Y, and black K. In this embodiment, images are formed in the order of cyan C, magenta M, yellow Y, and black K.

The charging roller 470 charges the exterior surface of the photoreceptor drum 420 with a uniform potential. The LSU 410 scans an optical signal corresponding to a cyan color image to the photoconductive material 421 of the photoreceptor 420 that is rotating. Due to a decrease in a resistance of a scanned portion of the photoconductive material 421, a charge attached onto the exterior surface of the photoreceptor drum 420 through the metal drum 422 comes off. Thus, a potential difference occurs between the scanned portion of the photoconductive material 421 and unscanned portions of the photoconductive material 421. As a result, a latent electrostatic image is formed on the exterior surface of the photoreceptor drum 420.

When the latent electrostatic image approaches the developer unit 430C due to the rotation of the photoreceptor drum 420, the developer roller 431 of the developer unit 430C starts rotating. Here, although it is an aspect of the invention that the developer rollers 431 of the developer units 430M, 430Y, and 430K do not rotate, the developer rollers 431 may rotate. The power supply 480 applies the first bias V1 to the developer roller 431 of the developer unit 430C. A method of determining the firs bias V1 was previously described, and it will not be repeated here.

The second bias V2 is applied to the developer rollers 431 of the developer units 430M, 430Y, and 430K which are not selected so as to prevent toner of unselected colors from sticking to the latent electrostatic image. Also, toner of a selected color adhered to the latent electrostatic image is prevented from sticking to the developer rollers 431 of the developer units 430M, 430Y, and 430K. A method of determining the second bias V2 was previously described, and thus it will not be repeated here.

Only the toner of the cyan color passes through the development gap Dg and sticks to the latent electrostatic image formed on the exterior surface of the photoreceptor drum 420 so that a cyan toner image is formed.

When the cyan toner image approaches the transfer belt 440 due to the rotation of the photoreceptor drum 420, the cyan toner image is transferred to the transfer belt 440 due to a potential difference or a contact pressure with the transfer belt 440 and the photoreceptor drum 420.

After the cyan toner image is completely formed on the transfer belt 440, magenta, yellow, and black toner images are formed and overlapped on the transfer belt 440 using the above-described process.

The cassette 495 feeds a sheet of paper S so that the end of the sheet of paper S reaches a place where the transfer belt 440 faces the transfer roller 445 when the end of the black toner image finally transferred to the transfer belt 440 reaches the place. When the sheet of paper S passes between the transfer belt 440 and the transfer roller 445, the cyan, magenta, yellow, and black color images are transferred to the sheet of paper S. The fixing unit 490 heats and presses the sheet of paper S to fix and fuse the cyan, magenta, yellow, and black toner images to the sheet of paper S and discharges the sheet of paper S to a stacker 496. As a result, a multi-color image is completed.

According to the above-described method, unlike a conventional color image forming apparatus, a color image forming apparatus of the present invention can form a multi-color image without rotating or sliding developer units.

As described above, color image forming apparatus and method according to the present invention can the follow effects.

Since a plurality of developer units are selected depending on whether first and second biases are applied to developer rollers, the sliding or rotating of the developer units does not make noise as in a conventional color image forming apparatus.

Also, the structure to slide or rotate the developer units is not required. Thus, since a driving mechanism can be simply constituted, the lifespan of the color image forming apparatus can be prolonged.

Furthermore, a multi-color image can be formed using only one photoreceptor medium and one exposing unit. In addition, since the structure to slide or rotate the developer units is not required, material costs can be reduced.

Moreover, by minimizing the operations of components of the color image forming apparatus, the deterioration of image quality due to the vibration of the color image forming apparatus can be prevented.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus, comprising:

a photoreceptor medium to form an image thereon to be transferred to a recording medium; and a plurality of developer units to supply toner to the image to develop the image, each developer unit being arranged around the photoreceptor medium so that developer rollers are separated from the photoreceptor medium by a gap; and a power supply to apply a first bias to allow toner to be supplied through the gap to the photoreceptor medium and a second bias to prevent toner from passing through the gap.

2. The image forming apparatus of claim 1, further comprising a laser scanning unit to scan the surface of the photoreceptor medium to expose a portion thereof in which developer is to be transferred from one of the plurality of developing units.

3. The image forming apparatus of claim 1, wherein each developing unit comprises:

a first potential which is applied to a respective developing unit roller to transfer developer to the photoreceptor medium; and a second potential which is applied to a respective developing unit roller to prevent developer from being transferred to the photoreceptor medium.

4. A color image forming apparatus comprising:

a photoreceptor medium;

an exposing unit that scans light onto the photoreceptor medium to form a latent electrostatic image;

a plurality of developer units that include developer rollers supplying toner to the latent electrostatic image to develop the latent electrostatic image into a toner image, each developer unit including toner of a different color, and the developer units being arranged around the photoreceptor medium so that the developer rollers are separated by a development gap from the photoreceptor medium; and a power supply that selectively applies a first bias allowing toner to be supplied through the development gap to the photoreceptor medium on which the latent electrostatic image is formed and a second bias preventing toner from passing through the development gap.

5. The color image forming apparatus of claim 4, wherein the toner is of a nonmagnetic-one-component-type.

6. The color image forming apparatus of claim 5, wherein the development gap is within a range of 50–400 $\mu$m.

7. The color image forming apparatus of claim 5, wherein only one of the developer rollers of the plurality of developer units to which the first bias is applied rotates.

8. The color image forming apparatus of claim 5, wherein the second bias is determined in consideration of a first contamination level where toner in the developer units of the plurality of the developer units that are not selected during a process of forming a multi-color image sticks to the latent electrostatic image formed on the photoreceptor medium and a second contamination level where toner adhered to the latent electrostatic image on the photoreceptor medium by the developer roller of the selected developer unit sticks to the developer rollers of the unselected developer units, so that an optical density corresponding to the first contamination level and an optical density corresponding to the second contamination level are equal to or smaller than 0.03.

9. The color image forming apparatus of claim 5, wherein the second bias electrically floats.

10. The color image forming apparatus of claim 5, wherein the second bias is selected between −600V and +50V.

11. A method of forming a multi-color image, the method comprising:

arranging a plurality of developer units including toner of different colors and developer rollers so that the developer rollers are separated by a development gap from a photoreceptor medium;

scanning light corresponding to an image of selected color onto the surface of the photoreceptor medium that is charged to form a latent electrostatic image;

applying a first bias to a developer roller of one of a plurality of developer units containing toner of a selected color so that toner of the selected color is fed to the latent electrostatic image via the development gap;

applying a second bias to developer rollers of developer units of the unselected developer units to prevent toner from moving through the development gap; and transferring a toner image formed on the photoreceptor medium to a transfer medium, wherein the above operations are repeated for toner of different colors to form a multi-color toner image on the transfer medium, transfer the multi-color toner image to a sheet of paper, fix and fuse the multi-color toner image to the sheet of paper, and form a multi-color image.

12. The method of claim 11, wherein the toner is of a nonmagnetic-one-component-type.

13. The method of claim 12, wherein the development gap is within a range of 50–400 $\mu$m.

14. The method of claim 12, wherein only one of the developer rollers of the plurality of developer units to which the first bias is applied rotates.

15. The method of claim 12, wherein the second bias is determined in consideration of a first contamination level where toner in the developer units of the plurality of the developer units that are not selected during a process of forming a multi-color image sticks to the latent electrostatic image formed on the photoreceptor medium and a second contamination level where toner adhered to the latent electrostatic image on the photoreceptor medium by the developer roller of the selected developer unit sticks to the developer rollers of the unselected developer units, so that an optical density corresponding to the first contamination level and an optical density corresponding to the second contamination level are equal to or smaller than 0.03.

16. The method of claim 12, wherein the second bias electrically floats.

17. The method of claim 12, wherein the second bias is selected between −600V and +50V.

18. A method of forming an image comprising:

arranging a plurality of developer units having a respective developer roller a predetermined distance from a photoreceptor medium;

charging the photoreceptor medium to form a latent electrostatic image thereon;

applying a first bias to one of the plurality of developer rollers containing toner of a selected color so that the toner is fed to a latent electrostatic image via the predetermined distance;

applying a second bias to the other developer rollers to prevent toner from moving through the predetermined distance; and repeating the above operations for each of the developer rollers to form a multi-color image on the photoreceptor medium.

19. A developer of an color image forming apparatus including a photoreceptor medium and a photoreceptor drum on which an image is formed, the developer comprising:

a plurality of developer units to develop the image;

a developer roller associated with each developer unit, the developer units being arranged around the photoreceptor medium such that the developer rollers are separated from the photoreceptor medium by a gap; and a power supply to apply a first bias such that toner is supplied to the photoreceptor medium through the gap and a second bias to prevent toner from passing through the gap.

* * * * *